US005314312A

United States Patent [19]

Ikemoto et al.

[11] Patent Number: 5,314,312

[45] Date of Patent: May 24, 1994

[54] FLUID-ROTATING APPARATUS

[75] Inventors: Yoshihiro Ikemoto, Katano; Teruo Maruyama, Hirakata, both of Japan

[73] Assignee: Matsushita Electric Industrial Co., Ltd., Osaka, Japan

[21] Appl. No.: 11,314

[22] Filed: Jan. 29, 1993

[30] Foreign Application Priority Data

Jan. 31, 1992 [JP] Japan ..... 4-016042
Jan. 31, 1992 [JP] Japan ..... 4-016043
Mar. 31, 1992 [JP] Japan ..... 4-076451

[51] Int. Cl.[5] ..... F04B 49/06

[52] U.S. Cl. ..... 417/16; 417/338; 417/410 C

[58] Field of Search ..... 417/16, 22, 338, 410 C

[56] References Cited

U.S. PATENT DOCUMENTS 4,718,833 1/1988 Berger ..... 417/16

FOREIGN PATENT DOCUMENTS 2123089 1/1984 United Kingdom ..... 417/338

*Primary Examiner*—Richard E. Gluck
*Attorney, Agent, or Firm*—Wenderoth, Lind & Ponack

[57] ABSTRACT

A fluid-rotating apparatus comprises a positive displacement pump structure section for rotating the rotary shaft of each of a plurality of rotors synchronously. In controlling the synchronous rotation of the rotary shafts by a PLL control method, a gain-switching means device is provided to set a high gain in a PLL control circuit when the rotary shafts are accelerating or decelerating and setting a low gain therein when the rotary shafts are rotating in a steady state.

6 Claims, 7 Drawing Sheets

*Fig. 7* - PRIOR ART
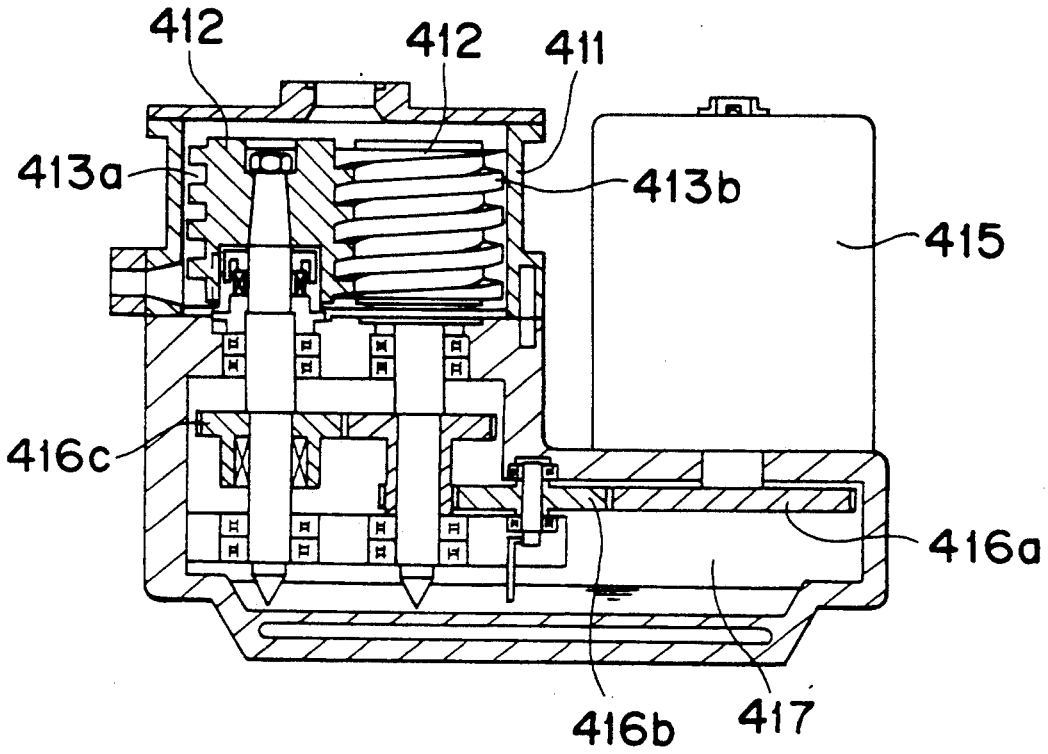

FLUID-ROTATING APPARATUS

BACKGROUND OF THE INVENTION

The present invention relates to a fluid-rotating apparatus and more particularly to a fluid-rotating apparatus, such as a positive displacement vacuum pump used to discharge gas from a vacuum chamber of a semiconductor-manufacturing apparatus, having a construction for synchronously rotating a plurality of rotary shafts at a high speed.

A vacuum pump for generating a vacuum environment is required by a CVD apparatus, a dry etching apparatus, a sputtering apparatus, an evaporating apparatus and the like to be used in the process for manufacturing semi-conductors. The vacuum pump is also used in the process of manufacturing a magnetic disk or a liquid crystal display.

In a positive displacement vacuum pump, two rotors having screws formed on the peripheral surface thereof are synchronously rotated with the screws engaging each other. The suction and compression of gas are repeated by changing the volume of a space formed between the screws so as to discharge gas. Each rotor is provided with a driving motor which is electrically controlled to rotate the rotors synchronously. A servo motor, the rotational speed of which can be freely controlled is used as the driving motor.

In the positive displacement vacuum pump, unless a plurality of motors, namely, a plurality of rotary shafts is synchronously rotated, the rotors collide with each other. As a result, a desired pumping operation cannot be performed and power is wastefully consumed and constituent components such as the rotors are damaged.

According to the conventional positive displacement vacuum pump, reference pulses are supplied from the same pulse generator to the control circuit of each motor for driving each of the rotary shafts. Each control circuit controls the rotation of each motor, namely, the rotation of each rotary shaft in conformity with the reference pulses. In this manner, the rotations of a plurality of rotary shafts are synchronized.

In recent years, there has been a strong demand for the development of a vacuum pump having a high operational performance due to the rapid processes of the process for manufacturing semiconductors. It is desirable for the processes for manufacturing semiconductor to become more and more highly integrated, to be able to increase the diameter of a wafer and vertically enlarge the wafer, and to be able to manufacture many kinds of semiconductors in small quantities. For high integration, it is necessary for the equipment to be clean. For the development of a wafer with a large diameter, the area occupied by the equipment must be small. For vertical enlargement of the wafer, complex processing (multi-chamber) is required. In order to manufacture many kinds of semiconductors in small quantities, the equipment must have a kind of network.

In order to comply with the above demands, it is necessary for the vacuum pump to be prevented from being polluted by oil or the like, to generate a high vacuum, to be corrosion-resistant, and to have a high efficiency per space.

Above all, the vacuum pump is required to generate vacuum over a wide range. Although a degree of vacuum as high as $10^{-8}$ to $10^{-10}$ torr is required in recent years, one vacuum pump is incapable of generating such a high vacuum. That is, a positive displacement vacuum pump called a roughing rotary pump is suitable for discharging gas in a viscous flow region, the pressure of which is almost equal to atmospheric pressure, but the degree of vacuum obtained by the vacuum pump is in the range from atmospheric pressure to a low vacuum degree of $10^{-3}$ torr. According to a kinetic vacuum pump called a turbo pump, one rotor imparts momentum to gas molecules by its rotation so that they are transported by the momentum. As a result, the gas is discharged from the vacuum chamber. The turbo pump generates a vacuum degree as high as $10^{-2}$ to $10^{-10}$ torr, but in principle, the turbo pump is capable of discharging gas from the vacuum chamber only in a molecular flow region, the vacuum degree of which is greater than $10^{-1}$ torr and smaller than $10^{-3}$. In order to obtain a high vacuum of $10^{-8}$ to $10^{-10}$ torr, it is necessary for a degree of vacuum of $10^{-2}$ to $10^{-3}$ torr to be generated by the rotary pump and then, for a predetermined high vacuum to be obtained by the turbo pump.

The use of two types of vacuum pumpleads to the installation of large equipment. That is, in order for equipment to accomplish composite processing (multi-chamber), each chamber is required to be equipped with an evacuating device. The use of two types of vacuum pumps for each chamber does not allow the entire evacuating apparatus to be compact. Consequently, space cannot be efficiently used and in addition, the equipment costs are high.

Accordingly, the conventional method is capable of rotating a plurality of rotary shafts at approximately the same number of rotations or at the same rotational speed, but is incapable of accurately synchronizing the rotational angles of a plurality of rotary shafts or phases thereof with each other.

In the positive displacement vacuum pump, a pair of rotors is required to rotate at a constant speed with a backlash maintained between screws of the rotors so that the rotors do not contact each other. Even though the position of each rotor is accurately set so that they do not contact each other in assembling the fluid-rotating apparatus, there is a possibility that the rotational positions of the rotors will become dislocated from a set rotational position during operation due to the difference between the inertial masses of the rotors, loads applied thereto or the performance of the motors. There is a great possibility that the rotational positions of the rotors will be dislocated from the set rotational position during acceleration of the rotors, during steady rotation thereof, and during the deceleration thereof.

According to the conventional method, the rotation characteristics of the rotary shafts are differentiated from each other because of the difference between loads applied thereto and inertial masses thereof even though the same reference pulse is supplied to the control circuit of each motor. Thus, the rotors cannot be prevented from becoming dislocated slightly from the set rotational position.

FIG. 7 shows an example of another conventional positive displacement vacuum pump in which screws are formed on rotors. Two rotors 412 are provided in a housing 411 with the rotary shafts thereof parallel with each other. Screws are formed on the peripheral surface of each rotor 412. The recesses (grooves) 413*a* of one rotor 412 engage the projections 413*b* of the other rotor 412, thus forming a space therebetween. With the rotation of the rotors 412, the volume of the space is changed to perform operations for suction and discharge of gas.

In the above conventional positive displacement vacuum pump, timing gears 416 are provided as a means for rotating the two rotors 412 synchronously. That is, the rotation of a motor 415 is transmitted to one of the timing gears 416*c* engaging each other and disposed on the shaft of each rotor 412 via a driving gear 416*a* and an intermediate gear 416*b*. The phase of the rotary shaft of each of the rotors 412 is adjusted by the engagement between the timing gears 416*c*. In this type of vacuum pump, the gears are used to transmit the power of the motor 415 and rotate the rotors 412 synchronously. Consequently, lubricating oil filled in a mechanical-operating chamber 417 accommodating the gears is supplied to the gears. In addition, a mechanical seal 419 is provided between the mechanical-operating chamber 417 and a fluid-operating chamber 418 accommodating the rotors 412 so as to prevent the lubricating oil from penetrating into the fluid-operating chamber 418.

This type of vacuum pump, with the above-described construction, having two rotors has the following drawbacks:

1). Many gears are required to transmit the power of the motor and rotate the rotors synchronously. Therefore, the vacuum pump is composed of many parts and thus its construction is complicated.

2). Gears which rotate in mesh are required to rotate the rotors synchronously. Accordingly, the rotors cannot be rotated at a high speed and the vacuum pump is large.

3). It is necessary to replace the mechanical seal periodically when it becomes worn, namely, it is not maintenance-free.

4). Since the sliding torque of the mechanical seal is great, mechanical loss is large.

In order to overcome these drawbacks, there has been proposed a positive displacement vacuum pump comprising a plurality of rotors, each driven by an independent motor and rotated synchronously by a method using a detecting means such as a rotary encoder for detecting the rotational angle of each rotor and/or the number of rotations thereof. This vacuum pump does not include components such as gears which are operated in sliding contact with each other. The vacuum pump allows the rotors to be rotated at a high speed synchronously, eliminates maintenance, is clean, and is compact.

In the proposed vacuum pump, each rotor is provided with an independent motor which is electrically controlled to accomplish the synchronous rotation of the motors. A servo motor, the rotational speed of which can be freely controlled, is used as the motor.

As described previously, in the positive displacement vacuum pump, unless a plurality of motors, namely, a plurality of rotary shafts is synchronously rotated with a high accuracy, the rotors collide with each other. As a result, a desired pumping operation cannot be performed and power is wastefully consumed and constituent components such as the rotor are damaged. The synchronous rotation means that the rotational speeds of a plurality of rotary shafts coincide with each other and the rotational positions thereof, namely, the phases thereof coincide with each other.

In order to control the operation of a plurality of rotary shafts, phase locked loop (PLL) control is used to control the operation of driving motors so that the phase of a reference frequency used as the reference of the rotation of the rotary shaft coincides with the phase information of the rotary shaft detected by an encoder mounted on each rotary shaft.

In the PLL control, the oscillation frequency of a crystal oscillator is used as a reference frequency. A frequency to be compared with the oscillation frequency is detected by a frequency generator coaxial with the motor so as to control (compare) the phases of both frequencies. In this manner, the stabilized rotational speed of the motor can be obtained. The rotations of a plurality of rotary shafts are synchronized by supplying the same reference frequency to a PLL control circuit which drives the motor for rotating each rotary shaft.

According to the above-described method for controlling the drive of the rotary shafts of the positive displacement vacuum pump, the gain of the control circuit is set equally at the operation start point of the rotary shaft, during deceleration, at its stop point, and its during steady operation. Therefore, electric power is wastefully consumed. The reason is as follows:

It is necessary to make the power of the motor large in order to accelerate and decelerate the rotation speed of the rotary, shaft greatly. Even a slight degree of disturbance influences the rotation the rotary shaft. For example, if a load fluctuates, the rotational speed of the rotary shaft may be changed. In the positive displacement vacuum pump, it is necessary to synchronize the rotations of the rotary shafts with each other during acceleration deceleration. Therefore, the level of speed instruction signals supplied to the control circuit of each rotary shaft are changed equally. But the rotations of the rotary shafts become asynchronous owing to the fluctuation in the rotational speed and rotational position thereof caused by an external factor. It is necessary for the control circuit of each rotary shaft to reliably control the rotation of the rotary shaft so that the rotations of all the rotary shafts are synchronized. To this end, the gain (amplification factor) of the control circuit should be great. With a great gain, the rotational speed and position of the rotary shaft fluctuated by a disturbance can be restored to the original correct state by a great power.

However, electrical energy is increasingly consumed with the increase of the gain and thus a large amount of electric power is required.

Since the inertia effect works during steady operation of the rotary shaft, the synchronous rotation of a plurality of rotary shafts can be maintained even though a disturbance is applied thereto. Accordingly, during steady rotation of the rotary shaft, it is unnecessary to use a control circuit in which a large gain has been set. The use of the control circuit in which a great gain has been set is a wasteful consumption of electrical energy.

Unlike with a fluid-rotating apparatus in which the rotary shaft is started and stopped frequently and is accelerated and decelerated greatly, electrical energy is wastefully consumed and running costs are high in fluid-rotating apparatus which are operated mainly in a steady operation according to the conventional control method. The positive displacement vacuum pump described previously is operated mostly in the steady operation.

SUMMARY OF THE INVENTION

It is an object of the present invention to provide a fluid-rotating apparatus in which not only the number of rotations of a plurality of rotary shafts or the rotational speeds thereof is synchronized with each other, but also the phases of the rotary shafts can be synchronized with each other easily and accurately.

It is another object of the present invention to provide a fluid-rotating apparatus which does not consume electric power wastefully in controlling the rotations of a plurality of rotary shafts, and is capable of suitably controlling the rotation of the shafts.

In accomplishing these and other objects, according to the first aspect of the present invention, there is provided a fluid-rotating apparatus comprising: a plurality of rotors accommodated in a housing; a first and second rotary shafts installed on the rotors, respectively; a plurality of motors each for driving one of the rotary shafts independently; a rotation-detecting means for detecting one of a rotational angle of each motor and a number of rotations thereof; a sucking opening and a discharge opening formed in the housing; and a positive displacement pump structure section formed by the housing and the rotors, characterized in that the first rotary shaft functions as a driving side rotary shaft, and the second rotary shaft thereof functions as a driven side rotary shaft, and the first rotary and the second rotary shaft are synchronously rotated by means for controlling rotation of the second rotary shaft based on information detected by the rotation-detecting means provided on the first rotary shaft.

According to the first aspect of the present invention, based on the rotational position of one rotary shaft functioning as the driving side shaft, the means for rotating the other shaft, for example, the means for rotating the driven side shaft is controlled to control the rotation of the driven side shaft. As a result, the rotation of the driven side shaft can be synchronized with that of the driving side shaft. If the rotation of the driving side shaft or that of the driven side shaft fluctuates, the rotational position of the driven side shaft can be altered in conformity with that of the driving side shaft. Accordingly, both shafts can be rotated synchronously irrespective of the change in the operation of the shafts, namely, operational change at the time of rise, steady operation, and acceleration and deceleration.

According to the second aspect of the present invention, there is provided the fluid-rotating apparatus in which the driving side rotary shaft has a relatively great moment of inertia and the driven side rotary shaft has a relatively small moment of inertia.

According to the second aspect of the present invention, shaft having a larger moment of inertia functions as the driving side shaft and a shaft having a smaller moment of inertia functions as the driven side shaft. In this manner, the rotational speed and position of the driven side shaft can be easily adjusted to those of the driving side shaft. This is because the rotational speed and position of the shaft having the smaller moment of inertia can be altered to a desired rotational speed and position faster and with a smaller force than the shaft having the larger moment of inertia. The shaft having the larger moment of inertia is less subjected to an external factor than the shaft having the smaller moment of inertia in the rotation thereof. In this manner, the alteration amount of the rotational speed and position of the shaft is small. That is, the driven side shaft is capable of following the fluctuation in the rotational speed and position of the driving side shaft.

According to the third aspect of the present invention, there is provided the fluid-rotating apparatus in which the driving side rotary shaft is driven by an induction machine and the driven side rotary shaft is driven by an AC servo motor.

According to the fourth aspect of the present invention, there is provided the fluid-rotating apparatus in which the driving side rotary shaft is driven by a high frequency motor.

According to the third and fourth aspects of the present invention, the driving side shaft is rotated by an induction machine, for example, a high frequency motor and the driven side shaft is rotated by an AC servo motor. Utilizing the features of both motors and based on the control over the rotation of the high frequency motor having a stable rotational speed, the AC servo motor, the rotation of which can be controlled easily and accurately is controlled. Consequently, a plurality of shafts can be rotated reliably and synchronously. Since it is unnecessary to control the rotation of the driving side shaft for a synchronous rotation, the high frequency motor, the rotation of which is difficult to be controlled can be reliably used. Since the high frequency motor which is less expensive than the AC servo motor contributes to the reduction of cost.

According to the fifth aspect of the present invention, there is provided the fluid-rotating apparatus which further comprises: a PLL control circuit for rotating the driven side rotary shaft synchronously with the driving side rotary shaft under PLL control operation; and a gainswitching means for setting a great gain in the PLL control circuit when the driving side rotary shaft is accelerating or decelerating, and setting a small gain therein when the driving side rotary shaft is rotating in a steady state.

According to the sixth aspect of the present invention, there is provided a fluid-rotating apparatus comprising: a plurality of rotors accommodated in a housing; a first and second rotary shafts installed on the rotors, respectively; a plurality of motors each for driving one of the rotary shafts independently; a rotation-detecting means for detecting one of a rotational angle of each motor and a number of rotations thereof; a sucking opening and a discharge opening formed in the housing; and a positive displacement pump structure section for sucking and discharging fluid by utilizing volume change in a space formed between the rotors and the housing, as a result of synchronous drive of the motors controlled by signals detected by the rotation-detecting means, characterized by further comprising:

a PLL control circuit for rotating the driven side rotary shaft synchronously with the driving side rotary shaft under PLL control operation; and a gain-switching means for setting a great gain in the PLL control circuit when the driving side rotary shaft is accelerating or decelerating, and setting a small gain therein when the driving side rotary shaft is rotating in a steady state.

According to the fifth and sixth aspects of the present invention, the following advantages are obtained.

In controlling the rotation of the rotary shaft by PLL control method, action for returning a fluctuated rotational speed or position of the shaft to the original correct rotational state works greatly and much electrical energy is consumed by setting a large gain in the PLL control circuit. If a small gain is set in the PLL control circuit, electrical energy is consumed in a small amount, but the control over the rotation of the rotary shaft cannot be reliably made.

The gain switching means of the PLL control circuit allows the changed rotational speed or position of the shaft to be reliably and rapidly restored to the original state by setting a great gain in the control circuit during the acceleration or deceleration time in which the rotational speed or position of the shaft is likely to change. When a plurality of shafts are synchronously rotating, a speed change which has occurred in each shaft is returned to a desired speed during the acceleration or deceleration of the shaft through the same process without the shafts being unsynchronized with each other.

A small gain is set in the PLL control circuit during the steady rotation of the rotary shaft. Since a rotational change thereof is smaller when the shaft is rotating in the steady state, electrical energy can be saved.

In this manner, the control over the rotation of each shaft can be appropriately made and a plurality of shafts can be synchronously rotated during the accelerated or decelerated rotation and steady rotation thereof. In addition, electrical energy is not wastefully consumed.

BRIEF DESCRIPTION OF THE DRAWINGS

These and other objects and features of the present invention will become clear from the following description taken in conjunction with the preferred embodiments thereof with reference to the accompanying drawings, in which:

FIG. 7 is a sectional view showing the entire construction of a conventional fluid-rotating apparatus.

DETAILED DESCRIPTION OF THE INVENTION

Figure 1:
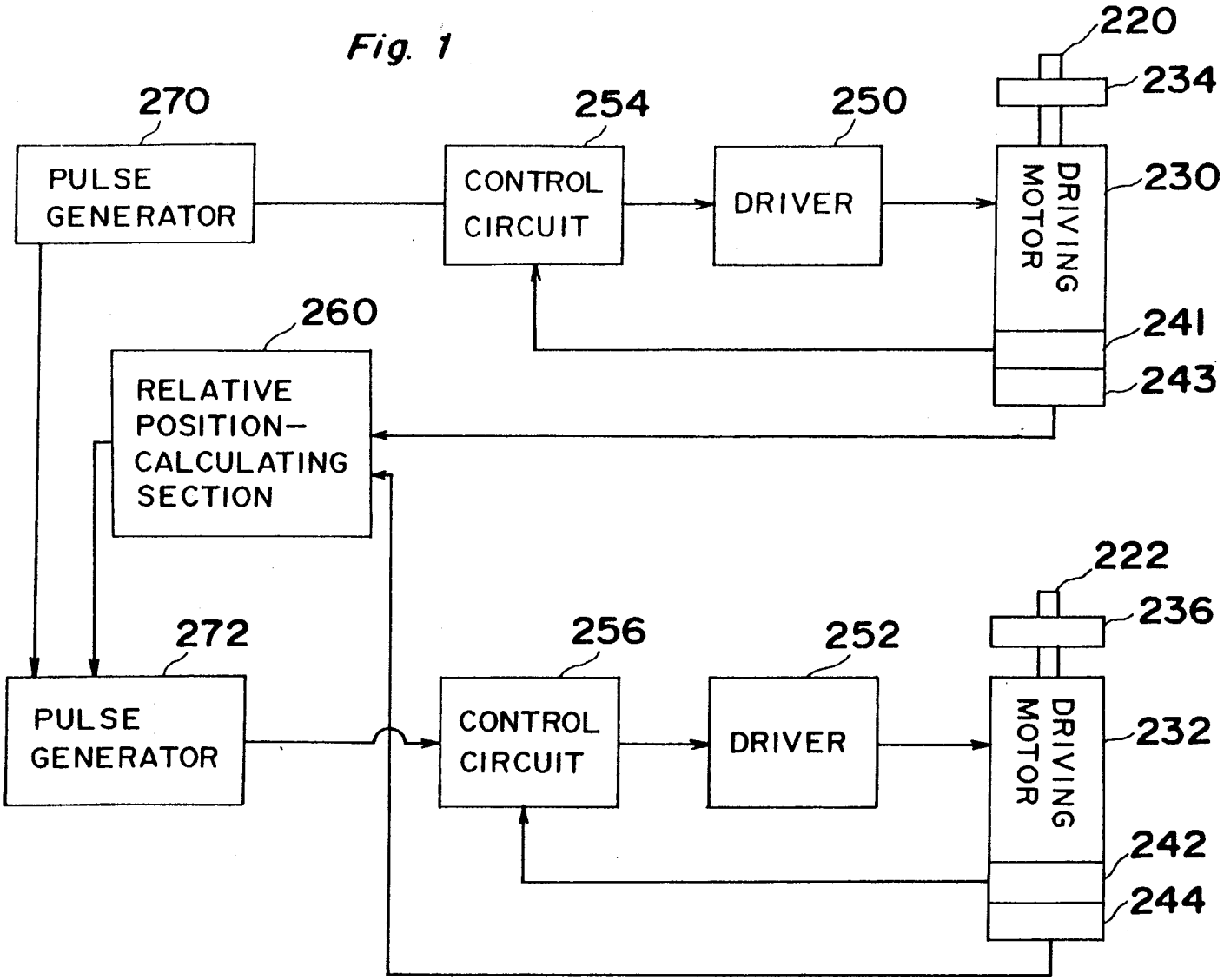
FIG. 1 is a block diagram showing regarding a control for synchronizing the rotations of a plurality of shafts of a fluid-rotating apparatus according to a first embodiment of the present invention.

Before the description of the present invention proceeds, it is to be noted that like parts are designated by like reference numerals throughout the accompanying drawings.

A fluid-rotating apparatus according to a first embodiment of the present invention is described below with reference to FIG. 1 showing a block diagram for synchronously rotating rotary shafts thereof.

Loads 234 and 236 having a certain moment of inertia are mounted on each of the rotary shafts 220 and 222 driven by each of a pair of driving motors consisting of servo motors 230 and 232, respectively. Incremental encoders 241 and 242 and absolute encoders 243 and 244 are mounted on the motors 230 and 232, respectively. The incremental encoders 241 and 242 detect the information of the number of rotations of the motors 230 and 232, namely, the rotational speeds thereof. The absolute encoders 243 and 244 detect the information of the rotational positions of the motors 230 and 232, namely, the phases thereof or the angular displacement amounts thereof. Control circuits 254 and 256 are connected with the motors 230 and 232, respectively, via each of motor drivers 250 and 252. Pulse generators 270 and 272 are connected with the control circuits 254 and 256, respectively.

The mechanism for controlling the rotational speeds of the rotors of the AC servo motors is described below. The pulse generators 270 and 272 generate pulses serving as references of the rotational speeds of the motors 230 and 232, and transmit the pulses to the control circuits 254 and 256, respectively. The control circuits 254 and 256 control the drive of the motors 230 and 232 via the drivers 250 and 252, respectively. The motors 230 and 232 are respectively driven at predetermined rotational speeds, and the information of the rotational speeds thereof detected by the incremental encoders 241 and 242 is fed back to the control circuits 254 and 256, respectively. The control circuits 254 and 256 compare the detected rotational speeds of the motors 230 and 232 and target rotational speeds thereof determined by the reference pulse frequencies. The control circuits 254 and 256 increase or decrease the rotational speeds of the motors 230 and 232 according to the detected difference. In this manner, the rotational speeds of the motors 230 and 232 are stabilized and constant rotational speeds can be obtained. The reference pulse frequency generated by the pulse generator 270 provided on the motor 230 is transmitted to the pulse generator 272 provided on the other motor 232 so that the pulse frequency generated by the pulse generator 272 coincides with that generated by the pulse generator 270. If the reference pulse frequency of the pulse generator 270 is equal to that of the pulse generator 272, the rotational speed of the motor 230 and that of the motor 232 are equal to each other. In this manner, the rotational speed of the motor 232 is synchronized with that of the motor 230. In this case, the motor 230 functions as the driving side and the motor 232 functions as the driven side. In other words, the shaft 220 functions as the driving side and the shaft 222 functions as the driven side.

In the first embodiment, the information of the rotational position of each of the motors 230 and 232 detected by the absolute encoders 243 and 244 provided thereon is transmitted to a relative position-calculating portion 260. The relative position-calculating portion 260 compares the rotational positions of both motors 230 and 232 with each other, thus transmitting the result to the pulse generator 272 of the driven side motor 232. The pulse generator 272 increases or decreases pulses depending on the difference between the rotational position of the driving side motor 230 and that of the driven side motor 232. More specifically, if the rotational position of the motor 230 is advanced relative to that of the motor 232, the pulse generator 272 adds a certain number of pulses to the reference pulse to make the rotation of the motor 232 faster. On the other hand, if the rotational position of the motor 230 is behind that of the motor 232, the pulse generator 272 subtracts a certain number of pulses to delay the rotation of the motor 232. As a result, the rotational position of the motor 232 is synchronized with that of the motor 230.

In the first embodiment, the rotation-driving means such as the pulse generator 272 and the control circuit 256 disposed on the driven side shaft 222 are controlled based on the information of the rotational position of the motor 230 obtained by the absolute encoder 243 on the driving side shaft 220. In this manner, the rotational position of the driven side shaft 222 is synchronized with that of the driving side shaft 220.

In the first embodiment, the rotation of the motor 232, namely, the rotation of the driven side shaft 222 is synchronized with that of the driving side shaft 220 based on the rotational position of the motor 230, namely, that of the driving side shaft 220. The rotations of two or more driven side shafts 222 can be synchronized with the rotation of the driving side shaft 220 based on the rotational position of the shaft 220. The mechanism and method for controlling the means for rotating the driven side shaft 222 based on the information of the means for detecting the rotational position of the driving side shaft 220 can be constructed and carried out using a combination of control mechanisms and control methods of conventional rotation control devices.

A fluid-rotating apparatus according to a second embodiment of the present invention is described below with reference to FIG. 2. The control mechanism of the second embodiment is partly different from that of the first embodiment.

In the second embodiment, an induction machine, for example, a high frequency motor is used as the driving side motor 230. An invertor control mechanism is used as a driver 251 and a control circuit 255. The invertor control mechanism generates a stable frequency therein and thus does not comprise the pulse generator 270 of the first embodiment. Since the invertor control mechanism does not perform a feedback control of the rotational speeds of the motors 230 and 232, the apparatus does not include the incremental encoder 241. The driven side motor 232 consists of an AC servo motor as in the first embodiment and other components are also similar to those of the first embodiment.

The method for synchronizing the rotations of the motors 230 and 232 with each other is described below. The invertor control mechanism of the motor 230 generates signals of a stable frequency and hence, the invertor control mechanism transmits the signals to the pulse generator 272 of the driven side motor 232 as information of the pulse frequency. As a result, the driving side motor 230 and the driven side motor 232 are driven by the same pulse frequency and thus rotated synchronously. The relative position-calculating portion 260 compares the rotational positions of the motors 230 and 232 with each other, thus increasing or decreasing the number of pulses of the pulse generator 272 based on the compared result, in a manner similar to the first embodiment. In this manner, the rotational position of the driven side motor 232 is synchronized with that of the driving side motor 230.

Figure 3:
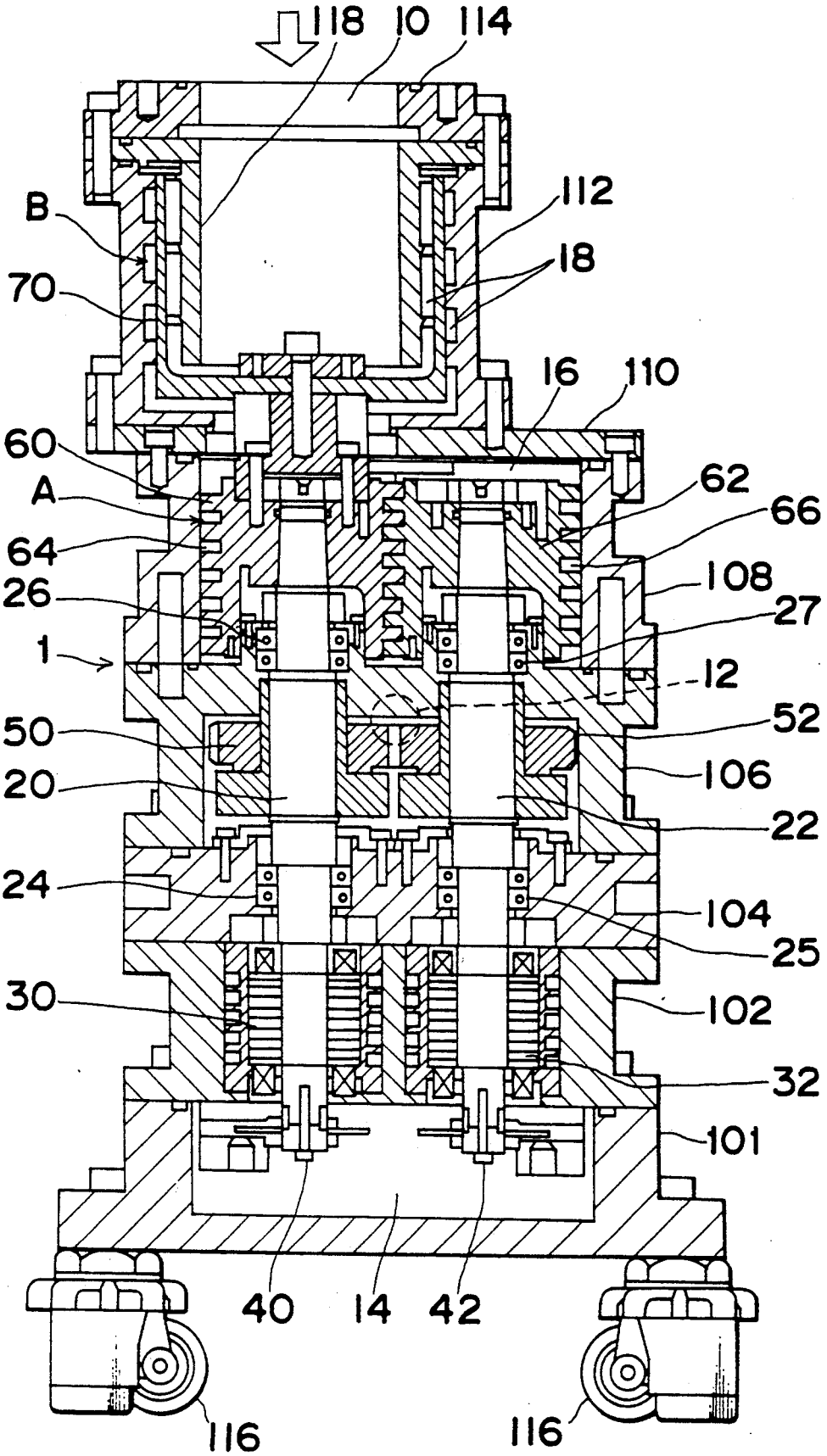
FIG. 3 is a sectional view showing as a third embodiment of the present invention the entire construction of a fluid-rotating apparatus which can be applied to the first and second embodiments.

The entire construction of the fluid-rotating apparatus applicable to the first and second embodiments in accordance with the present invention will be described below with reference to FIG. 3 showing the construction of a vacuum pump, namely, a fluid-rotating apparatus for generating a wide degree of vacuums.

This vacuum pump comprises a housing 1 accommodating a positive displacement pump structure section (A) and a kinetic pump structure section (B) disposed above the positive displacement pump structure section (A). The kinetic pump structure section (B) sucks fluid, for example, gas from a suction opening 10 installed in the housing 1 and feeds gas to the positive displacement pump structure section (A). The positive displacement pump structure section (A) discharges the gas from a discharge opening 12 installed in the housing 1.

The construction of the positive displacement pump structure section (A) is described below. Driving motors 30 and 32 are respectively installed on lower portions of rotary shafts 20 and 22 which are vertical and parallel with each other. Rotation-detecting encoders 40 and 42 disposed at the lower ends of the shafts 20 and 22, respectively, are accommodated in an encoder-accommodating chamber 14 of the housing 1. The shafts 20 and 22 are rotatably fixed to the housing 1 by bearings 24 and 25, respectively. Contact-preventing gears 50 and 52 disposed above the bearings 24 and 25 are installed on the shafts 20 and 22, respectively. The shafts 20 and 22 are also fixed to the housing 1 by the bearings 26 and 27, respectively, disposed above the contact-preventing gears 50 and 52. Rotors 60 and 62 disposed above the bearings 26 and 27 are installed on the shafts 20 and 22, respectively.

The rotors 60 and 62 are accommodated in a pump chamber 16 of the housing 1. The lower portion of the pump chamber 16 communicates with the discharge opening 12. The rotors 60 and 62 rotate in reverse directions, with thread grooves 64 and 66 respectively formed on the peripheral surfaces of the rotors 60 and 62 engaging each other. The volume of a space formed by the inner wall of the pump chamber 16 and the rotors 60 and 62 changes periodically. As a result, pumping a operation is performed. That is, gas is suction from the sucking opening 10 of the pump chamber 16 and is fed downward. The construction of positive displacement pumps of various conventional fluidrotating apparatuses may be adopted as the construction of the rotors 60 and 62 of the positive displacement pump structure section (A).

The contact-preventing gears 50 and 52 are respectively mounted on the shafts 20 and 22 to prevent the rotors 60 and 62 from contacting each other. That is, there is a predetermined backlash gap between the tooth (screw thread) of the contact-preventing gear 50 and the mating tooth of the contact-preventing gear 52. The contact-preventing gears 50 and 52 do not contact each other when the shafts 20 and 22 are rotating synchronously. If the shafts 20 and 22 are rotating a synchronously, the contact-preventing gears 50 and 52 contact each other before the rotors 60 and 62 contact each other. In this manner, the rotors 60 and 62 can be prevented from being brought into contact with each other or damaged. Due to the provision of the contact-preventing gears 50 and 52, the rotation of the shaft 20 and that of the shaft 22 are a synchronous with each other beyond the backlash between the tooth of the contact-preventing gear 50 and the mating tooth of the contact-preventing gear 52.

In order to attain the above operation, the backlash between the tooth of the contact-preventing gear 50 and the mating tooth of the contact-preventing gear 52 is made to be smaller than that between the mating thread grooves 64 and 66 of the rotors 60 and 62. Preferably, a solid lubricating film is formed on the tooth surfaces of the contact-preventing gears 50 and 52 so as to reduce the friction therebetween.

The above-described synchronous rotation method allows the shafts 20 and 22 to be rotated synchronously even though the pump is not provided with the contact-preventing gears 50 and 52. But the shafts 20 and 22 can be reliably rotated synchronously by providing both the above-described means for carrying out the method for electrically synchronizing the rotation of the shaft 20 and that of the shaft 22 and the contact-preventing gears 50 and 52 for mechanically preventing the asynchronous of the shafts 20 and 22. For example, even though an electrical accident or failure occurs, the contact-preventing gears 50 and 52 prevent the rotors 60 and 62 from being damaged. In addition, owing to the adoption of the means for electrically synchronizing the rotations of the shafts 20 and 22 with each other, it is unnecessary to operate the contact-preventing gears 50 and 52 during the normal operation of the fluid-rotating apparatus. That is, the contact-preventing gears 50 and 52 are worn or damaged less, less noise is generated and less power is consumed.

The encoders 40 and 42 detect the rotational speed of each of the shafts 20 and 22 and the rotational position thereof. That is, the encoders 40 and 42 incorporate the incremental encoder and the absolute encoder. The motors 30 and 32 are controlled to synchronously rotate the shafts 20 and 22 based on the information of the detected rotational speeds and rotational positions thereof. The construction and the mechanism as shown in FIGS. 1 and 2 are applied to the construction of the encoders 40 and 42 and the method for controlling the motors 30 and 32 based on the information detected by the encoders 40 and 42. More specifically, the shafts 20 and 22 correspond to the driving side shaft 220 and the driven side shaft 222, respectively; the motors 30 and 32 correspond to the motors 230 and 232, respectively; the encoder 40 corresponds to the incremental encoder 241 and the absolute encoder 243; and the encoder 42 corresponds to the incremental encoder 242 and the absolute encoder 244. An optical cable may be used to transmit information from the encoders 40 and 42 to the control device so as to prevent information from being erroneously detected due to electrical noise and to prevent the control for the synchronous rotation of the shafts 220 and 222 from being unstable.

It is necessary to prevent foreign matter such as dust from entering into the encoder-accommodating chamber 14 in order to ensure the operation of the encoders 40 and 42. To this end, it is effective to dispose a magnetic fluid seal in a boundary, between the encoder-accommodating chamber 14 and a space disposed above the encoder-accommodating chamber 14, through which the shafts, 20 and 22 extend. A gas purge means for maintaining pressurization of the encoder-accommodating chamber 14 at a constant pressure by use of nitrogen gas or the like, may be provided in the housing 1. The magnetic fluid seal and the gas purge means are provided between the pump chamber 16 and the bearings 26 and 27 or between the pump chamber 16 and the motors 30 and 32 so as to prevent corrosive gas from entering into the apparatus.

The construction of the kinetic pump structure section (B) disposed above the positive displacement pump structure section (A) is described below as a third embodiment.

The shaft 20 extends upward from the pump chamber 16 of the positive displacement pump structure section (A). A cylindrical rotor 70 is mounted on the upper end of the shaft 20. The rotor 70 is accommodated between the inner wall of the housing 1 and a cylindrical inner partitioning wall 118 integrally attached to the housing 1. A thread groove is formed on the inner wall of the housing 1 (frame 112) and the outer wall of the inner partitioning wall 118. A pumping space 18 is formed between the thread grooves and the inner wall of the rotor 70 as well as the outer wall thereof. With the rotation of the rotor 70, fluid such as gas suction from the sucking opening 10 is fed upward via a gap between the thread groove formed on the inner partitioning wall 118 and the inner wall of the rotor 70 and then downward via a gap between the thread groove formed on the inner wall of the housing 1 and the outer wall of the rotor 70. That is, in this construction, the rotor 70 imparts momentum to gas molecules in contact with the rotor 70 by the rotation thereof. In this manner, gas discharging and pumping operations are performed. While gas is being transported along the inner and outer wall surface of the rotor 70, a great momentum can be imparted to gas molecules for a long time and the pumping operation can be performed efficiently. The pumping space 18 communicates with the pump chamber 16 of the positive displacement pump structure section (A) and thus gas discharged from the kinetic pump structure section (B) is fed to the positive displacement pump structure section (A).

In addition to the above construction, the constructions of kinetic pumps of conventional fluidrotating apparatuses can be adopted as that of the kinetic pump structure section (B).

The construction of the housing 1 accommodating the positive displacement pump structure section (A) and the kinetic pump structure section (B) is described below.

The housing 1 comprises a plurality of frames 101, 102, 104, 106, 108, 110, 112, and 114 layered one on the other. The lowermost frame 101 constitutes the encoder-accommodating chamber 14 and is provided with a pair of casters 116, for moving the entire apparatus, disposed at the lower ends thereof. The frame 102 adjacent to the frame 101 accommodates the motors 30 and 32. The frame 104 accommodates the bearings 24 and 25. The frame 106 accommodates the contact-preventing gears 50 and 52. The frame 108 accommodates the rotors 60 and 62 and constitutes the pump chamber 16. The frame 110 closes the upper end of the pump chamber 16 and constitutes a fluid path extending from the kinetic pump structure section (B) to the positive displacement pump structure section (A). The driving shaft 20 extends upward through the frame 110. The frame 112 accommodates the rotor 70 of the kinetic pump structure section (B). The uppermost frame 114 is installed on the frame 112 with the inner partitioning wall 118 sandwiched therebetween, thus constituting the suction opening 10 for fluid (gas). The frames 101 through 114 have horizontal surfaces which are connected with each other by bolts.

In assembling the housing 1, the frames 101 through 114 are layered one on the other in the order from the lower one to the upper one, the shafts 20 and 22 are disposed in the center of each of the frames 101 through 114, and the components such as the encoders 40 and 42 and the motors 30 and 32 are mounted in the frames 101 through 114 at predetermined positions thereof. In disassembling the housing 1, the frames 101 through 114 are removed in the order from the upper one to the lower one and the components are also removed. It is possible to assemble the housing 1 in the order from an intermediate frame upward to the upper frames and downward to the lower frames.

In the third embodiment, the components can be incorporated in the frames 101 through 114 easily and accurately while the frames 101 through 114 are sequentially connected with each other. Thus, the fluid-rotating apparatus can be assembled very easily. In particular, since each component such as the encoders 40 and 42 and the motors 30 and 32 are separately accommodated in the frames 101 through 114, each component and the frames 101 through 114 can be position-adjusted with high accuracy. That is, the housing 1 can be assembled with efficiency and accuracy.

The housing 1 may comprise varied numbers of frames and the lengths of the frames may be varied.

According to the third embodiment, the fluidrotating apparatus is operated not only with the positive displacement pump structure section (A) cooperating with the kinetic pump structure section (B), but also the positive displacement pump structure section (A) may be used independently. That is, the rotor 70 of the kinetic pump structure section (B) is removed from the upper end of the shaft 20, and the frame 110 is also removed from the frame 108 constituting the pump chamber 16 of the positive displacement pump structure section (A). Then, a cover having a suction opening formed thereon is installed on the upper end of the frame 108 so that fluid sucked from the suction opening is discharged from the discharge opening 12 by the operation of the kinetic pump structure section (B). This construction is effective for efficiently generating a low or an intermediate degree of vacuum as a roughing operation.

In the above-described vacuum pump, preferably, the shaft 20 having a large moment of inertia due to the installation of the rotor 70 of the kinetic pump structure section (B) thereon functions as the driving side shaft 220, and the shaft 22 having a smaller moment of inertia functions as the driven side shaft 222. When only the positive displacement pump structure section (A) is used by removing the kinetic pump structure section (B) from the fluid-rotating apparatus, the number of rotations of the shaft 20, namely, the number of rotations of the driving side shaft 220 may be varied due to the fluctuation in the moment of inertia of the shaft 20 and the load thereof. But according to the fluid-rotating apparatus of the third embodiment, the shaft 22, namely, the driven side shaft 222 is capable of rapidly and accurately following the varied number of rotations of the driving side shaft 220.

The diameter and construction of the driving side shaft 220 and the driven side shaft 222 are set in consideration of a different moment of inertia if those of the rotors 60 and 62 of the positive displacement pump structure section (A) are different from each other.

Figure 4:
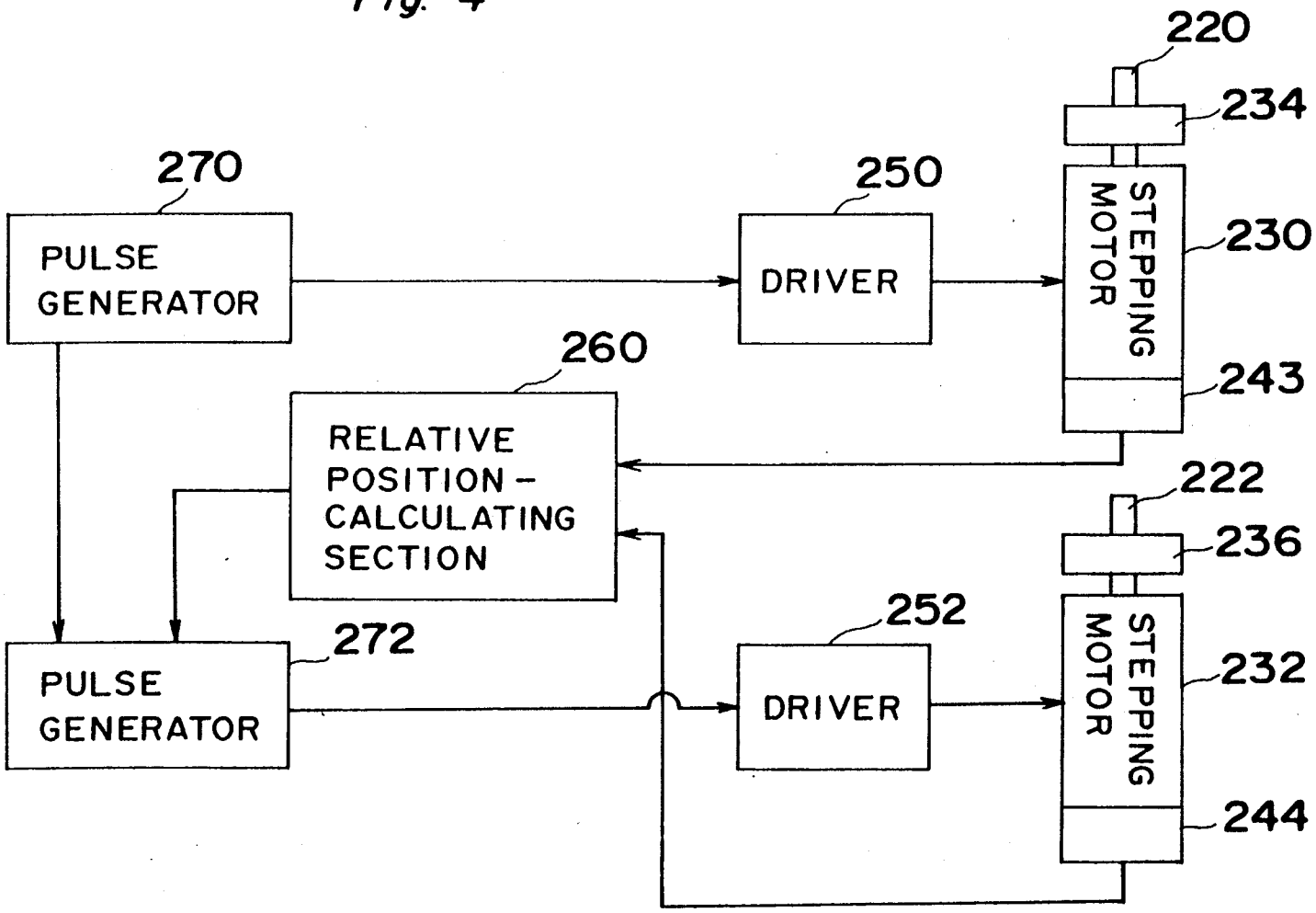
FIG. 4 is a block diagram showing a fourth embodiment.

In the first through third embodiments, either an AC servo motor is used as the driving side motor 230 and the driven side motor 232, or and a high-frequency motor is used as the motor 230 and the AC servo motor is used as the motor 232. Stopping motors may be used as the motors 230 and 232 according to a fourth embodiment which is described below with reference to FIG. 4.

The control mechanism of a fluid-rotating apparatus according to the fourth embodiment is partly different from that of the fluid-rotating apparatus according to the first or second embodiment.

In the fourth embodiment; the stepping motor is used as the driving side motor 230 and the driven side motor 232. Drivers 250 and 252 drive the stepping motors 230 and 232, respectively. The drivers 250 and 252 are rotated by pulses outputted from pulse generators 270 and 272, respectively. Therefore, it is unnecessary to provide the incremental encoders 241 and 242 and the control circuits 254 and 256 serving as constituent components for synchronously rotating the shafts 220 and 222. Similarly to the previous embodiments, the fluid-rotating apparatus includes the absolute encoders 243 and 244, the relative position-calculating portion 260, and the pulse generators 270 and 272.

The method for synchronously rotating the rotary shafts 220 and 222 is described below. The pulse generators 270 and 272 output pulses used as the references of the rotational speeds of the shafts 220 and 222 to the drivers 250 and 252. In response to the frequency of the reference pulses, the operations of the motors 230 and 232 are controlled via the drivers 250 and 252. When the frequency of the reference pulse outputted from the pulse generator 270 is equal to that outputted from the pulse generator 272, the rotational speed of the motor 230 is equal to that of the motor 232, and thus the synchronous rotation of the motors 230 and 232 can be accomplished. In the fourth embodiment, the motor 230 functions as the driving side motor and the motor 232 functions as the driven side motor. In other words, the rotary shaft 220 functions as the driving side shaft and the rotary shaft 222 functions as the driven side shaft.

In the fourth embodiment, the information of the rotational position of the motor 230 and that of the motor 232 detected by the absolute encoders 243 and 244 provided on the motors 230 and 232 are transmitted to the relative position-calculating portion 260. The relative positioncalculating portion 260 compares the rotational position of the motor 230 and that of the motor 232, and transmits the result obtained by the comparison to the pulse generator 272 of the motor 232. The pulse generator 272 increases or decreases pulses depending on the difference between the rotational position of the motor 230 and that of the motor 232. More specifical if the rotational position of the motor 230 is advanced relative to that of the motor 232, the pulse generator 272 adds a certain number of pulses to the reference pulse to increase the rotation speed of the motor 232. On the other hand, if the rotational position of the motor 230 is behind that of the motor 232, the pulse generator 272 subtracts a certain number of pulses to delay the rotation of the motor 232. As a result, the rotational position of the motor 232 is synchronized with that of the motor 230.

According to the fluid-rotating apparatus of the present invention, the rotational position of the rotary shafts, namely, the rotational position of the driven side shaft is synchronized with that of the other rotational shaft, namely, the driving side shaft, the rotational position of the driving side shaft being set as the reference position. Even though the rotation of the driving side shaft fluctuates, the driven side shaft is capable of following the fluctuated rotation of the driving side shaft immediately without being affected by an external factor such as a fluctuation in load or a fluctuation in operating conditions. In this manner, both shafts rotate synchronously with accuracy. In addition, a plurality of rotors is capable of rotating synchronously with accuracy. That is, the fluid-rotating apparatus has a favorable performance.

According to the fourth embodiment, a shaft having a larger moment of inertia functions as the driving side shaft and a shaft having a smaller moment of inertia functions as the driven side shaft. In this manner, the rotational speed of the driven side shaft and the rotational position thereof can be adjusted easily and rapidly, and the fluctuation in the rotation of the driving side shaft can be reduced. In this manner, a favorable synchronous rotation can be accomplished.

Further, the driving side shaft is rotated by an induction machine, for example, a high frequency motor which stabilizes the rotation and is inexpensive, and the driven side shaft is rotated by an AC servo motor, the rotation of which can be controlled easily and accurately. In this manner, the characteristics of both motors can be displayed.

The rotations of the shafts can be stabilized and no feedback control mechanism is required, by driving both the driving side shaft and the driven side shaft with stepping motors. As a result, a plurality of shafts can be rotated synchronously in a stable and accurate manner and thus the fluid-rotating apparatus costs are low.

Figure 5:
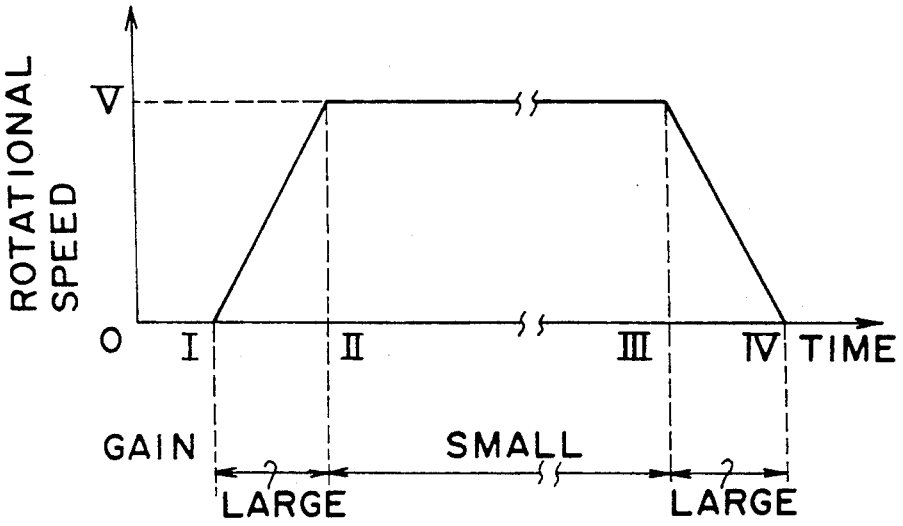
FIG. 5 is a graph for explaining a control method for synchronizing the rotations of a plurality of rotary shafts of a fluid-rotating apparatus according to the fourth embodiment.

FIG. 5 shows a graph showing the method for controlling the drive of the shafts of the fluid-rotating apparatus according to the fourth embodiment of the present invention. In the graph, the abscissa indicates the elapse of time and the ordinate indicates the rotational speed of the shaft.

The shaft starts rotating at a point I, and accelerates, reaches a predetermined speed V at a point II, and continues rotating at the predetermined steady speed V. The shaft decelerates at a point III to stop its rotation at a point IV. The speed change during the accelerated and decelerated rotation of the shaft and the value of the steady speed V are set by an operation panel or by supplying an instruction signal indicating a speed change to a PLL control circuit shown in FIG. 6 which stores an appropriate program in advance. The PLL control circuit is used to return to the predetermined speed the rotational speed of the shaft which has been changed due to an external factor such as the fluctuation in load or to adjust one shaft to synchronize the rotation of the shaft with that of the other shaft.

In controlling the rotational speed of the shaft, the gain of the PLL control circuit is set to be large during acceleration (I-II) and during deceleration (III-IV), and the gain thereof is set to be small during steady rotation (II-III) of the shaft. The PLL control circuit is provided with a gain switching means such as a change-over switch or a program which can be automatically altered so as to change the gain of the PLL control circuit.

During the acceleration (I-II) and the deceleration (III-IV) in which the gain of the PLL control circuit is large, a large power is applied to the motor of the shaft and hence a rapid speed change can be made. During the steady rotation (II-III), the fluctuation in the rotational speed of the shaft can be adjusted by a small gain, namely, by a small amount of power applied to the motor.

Figure 2:
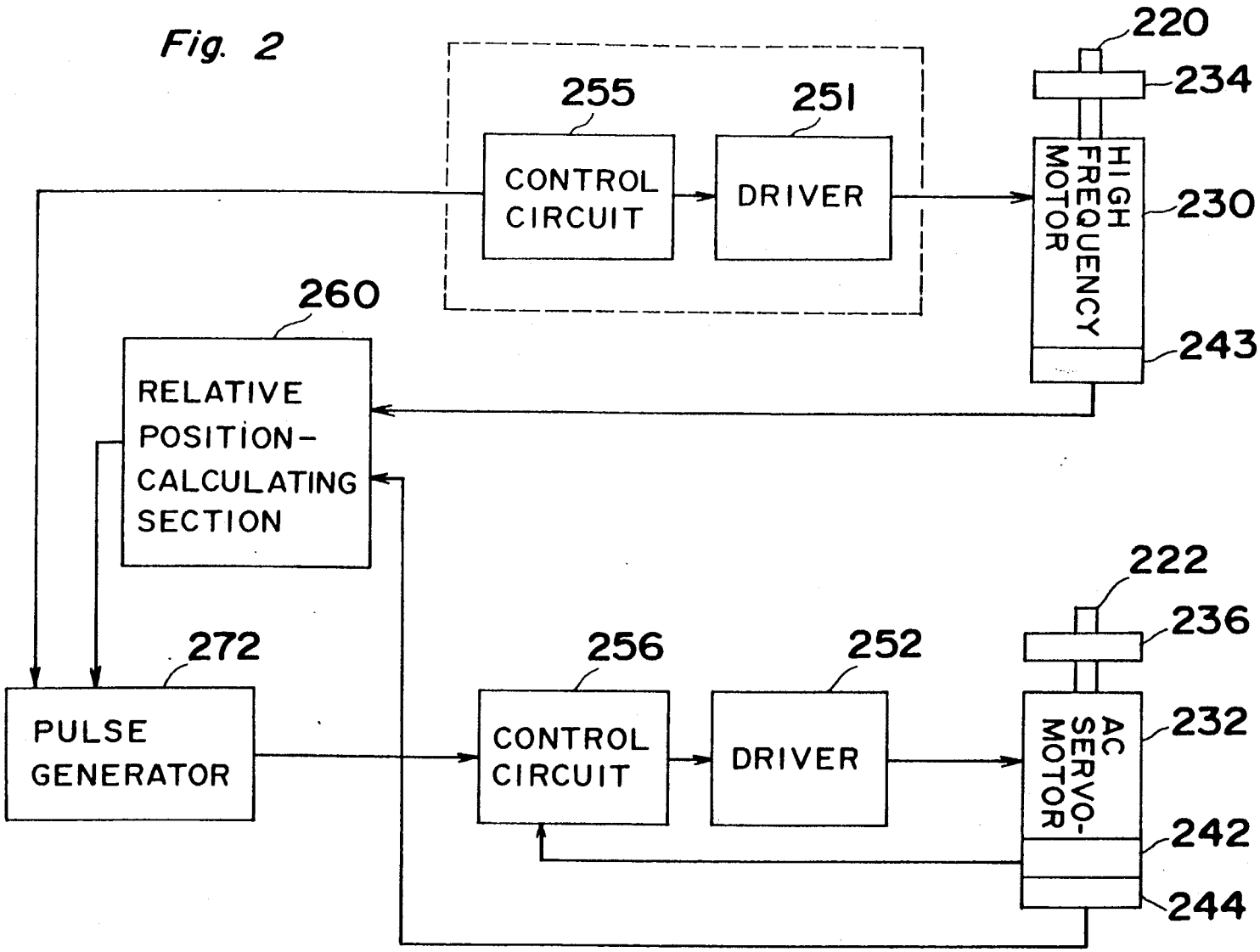
FIG. 2 is a block diagram showing a control arrangement for synchronizing the rotations of a plurality of rotary shafts of a fluid-rotating apparatus according to a second embodiment of the present invention.
Figure 6:
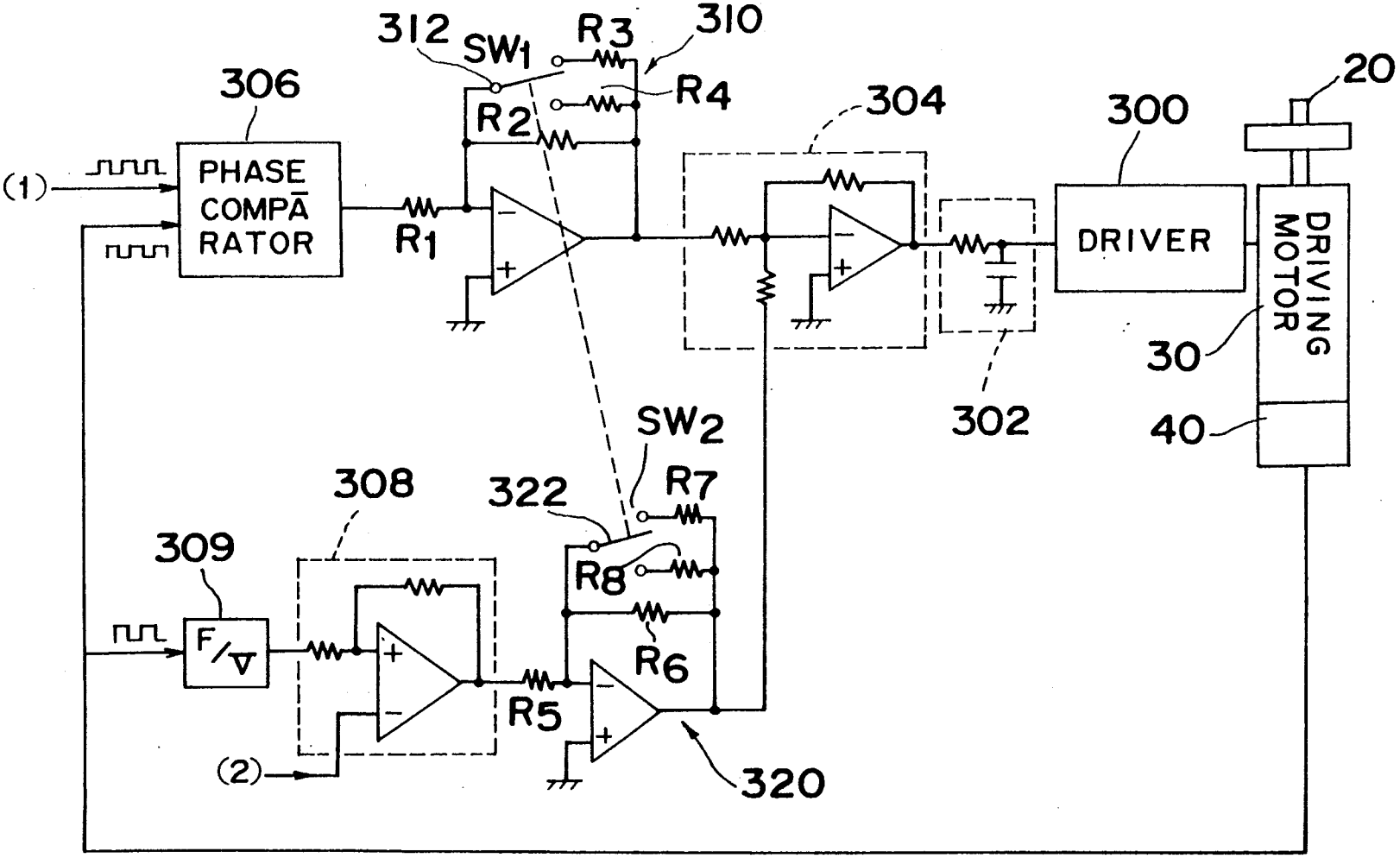
FIG. 6 is a circuit diagram showing the construction of a PLL control circuit.

FIG. 6 shows an example of the PLL control circuit applicable to the control circuits 256 in FIGS. 1 and 2. The construction of the control circuit is generally similar to that of a conventional PLL control circuit. That is, an encoder 40 for detecting the rotational speed of the rotary shaft 20 is installed on the motor 30 on which the rotary shaft 20 is installed. The encoder 40 is of incremental type. The PLL control circuit for controlling the drive of the motor 30 comprises a driver 300, a ripple filter 302, an adder 304, a gain controller for phase 310, a phase comparator 306, a gain controller for speed 320, a speed comparator 308, and a frequency/voltage converter 309.

The phase comparator 306 compares a reference signal (1) generated by a phase reference oscillator (not shown) with information of the rotation of the shaft detected by the encoder 40, and generates an error signal regarding the phase of the shaft. The error signal is amplified by the gain controller for phase 310 and outputted to the adder 304. The speed comparator 308 compares a reference signal (2) generated by a reference speed instruction voltage converter with the information of the rotation of the shaft detected by the encoder 40 with each other, and generates an error signal regarding the rotational speed of the shaft. The error signal is amplified by the gain controller for speed 320 and outputted to the adder 304. The adder 304 adds the amplified error signals of the phase and the speed to each other, and transmits the information obtained by the addition to the ripple filter 302 and the driver 300 so that the number of rotations of the motor 30 is increased or decreased to control the rotation of the motor 30.

Gain change-over switches 312 and 322 interlocked with each other are mounted on the gain controller for phase 310 and the gain controller for speed 320, respectively. The gain of the phase system gain controller 310 and that of the gain controller for speed 320 can be switched to a larger one or a smaller one by the gain change-over switches 312 and 322, respectively. That is, the resistance of the circuit is changed by the gain change-over switches 312 and 322 so as to control the gain of the gain controller for phase 310 and that of the gain controller for speed 320.

Accordingly, a great (high) gain is set in the PLL control circuit of the above construction during the acceleration and deceleration of the rotary shaft by the operation of the gain change-over switches 312 and 322, and a small (low) gain is set therein during the steady rotation of the rotary shaft.

Conventional circuit constructions and gain control methods used in conventional PLL control circuits can be applied to the construction of the PLL control circuit and the gain control method according to the present invention.

In the fourth embodiment, both the gain of the phase system gain controller 310 and that of the gain controller for speed 320 are switched by the gain change-over switches 312 and 322, but it is possible to switch only the gain of the gain controller for phase 310.

In the PLL control circuit, an optical cable can be utilized to transmit information from the encoders 40 and 42 to the control device so that the information can be transmitted without an error because it can prevent information from being erroneously detected due to electrical noise and prevent the control for synchronous rotation from being unstably performed.

In the vacuum pumps of the previous embodiments, when it is necessary to more accurately synchronize the rotational speeds of the shafts of the rotors 60 and 62 with each other and the phases of the shafts 60 and 62 with each other, a modification for carrying out such an operation is described below. The contact-preventing gears 50 and 52 are incapable of synchronizing the rotations of the rotors 60 and 62 with each other within the backlash between the tooth (screw thread) of the contact-preventing gear 50 and the mating tooth of the contact-preventing gear 52. When the tooth of the contact-preventing gear 50 contacts the mating tooth of the contact-preventing gear 52, noise is generated or power is wastefully consumed. Therefore, it is preferable that in normal operation the contact-preventing gears 50 and 52 rotate without contact.

The synchronous rotation of the shafts 20 and 22 can be more accurately controlled and electric power is not wastefully consumed by applying the above-described rotation control method shown in FIGS. 5 and 6. In synchronizing the rotation of the shaft 20 with that of the shaft 22, a correction is made on the signal (1) indicating the reference phase and the signal (2) indicating the reference speed before the signals (1) and (2) are supplied to the PLL control circuit of each of the shafts 20 and 22 so as to eliminate the difference between the phases or the speeds between both shafts 20 and 22. More specifically, for example, based on the information of the rotational speeds and positions of the shafts 20 and 22 detected by the encoders 40 and 42, a correction is made on the signals (1) and (2) so as to rotate the shaft 22 faster or slower and thereby synchronize the rotation of the shaft 22 with that of the shaft 20.

The gain switching means of the PLL control circuit of the fluid-rotating apparatus sets a great gain during the acceleration and deceleration of each rotary shaft so as to prevent change in the rotational speeds and positions of a plurality of shafts which are synchronously rotated, while the gain switching means sets a small gain during the steady rotation of each rotary shaft so as to save wasteful consumption of electric power. In this manner, a plurality of shafts can be appropriately and synchronously rotated during the acceleration and deceleration thereof. In addition, electric power is not wastefully consumed.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid-rotating apparatus comprising, a plurality of rotors accommodated in a housing; first and second rotary shafts installed on the rotors, respectively; a plurality of motors, each for driving one of the rotary shafts independently; a rotation-detecting means for detecting one of a rotational angle of each motor and a number of rotations thereof; a suction opening and a discharge opening forming in the housing; and a positive displacement pump structure section formed by the housing and the rotors;

characterized in that the first rotary shaft functions as a driving side rotary shaft; the second rotary shaft functions as a driven side rotary shaft; and a rotation controlling means is provided for controlling rotation of the second rotary shaft based on information detected by the rotation-detecting means provided on the first rotary shaft, to thereby synchronously rotate the first rotary shaft and the second rotary shaft;

wherein a PLL control circuit is provided for rotating the driven side rotary shaft synchronously with the driving side rotary shaft under PLL control operation; and wherein a gain-switching means is provided for setting a high gain in the PLL control circuit when the driving side rotary shaft is accelerating or decelerating, and setting a low gain therein when the driving side rotary shaft is rotating in a steady state.

2. The fluid-rotating apparatus as claimed in claim 1, wherein the driving side rotary shaft has a relatively greater moment of inertia and the driven side rotary shaft has a relatively small moment of inertia.

3. The fluid-rotating apparatus as claimed in claim 1, wherein the driving side rotary shaft is driven by an induction machine and the driven side rotary shaft is driven by an AC servo motor.

4. The fluid-rotating apparatus as claimed in claim 2, wherein the driving side rotary shaft is driven by an induction machine and the driven side rotary shaft is driven by an AC servo motor.

5. The fluid-rotating apparatus as claimed in claim 1, wherein the driving side rotary shaft is driven by a high frequency motor.

6. A fluid-rotating apparatus comprising: a plurality of rotors accommodated in a housing; first and second rotary shafts installed on the rotors, respectively; a plurality of motors, each for driving one of the rotary shafts independently; a rotation-detecting means for detecting one of a rotational angle of each motor and a number of rotations thereof; a suction opening and a discharge opening formed in the housing; and a positive displacement pump structure section for sucking and discharging fluid by utilizing volume change in a space formed between the rotors and the housing, as a result of synchronous drive of the motors controlled by signals detected by the rotation-detecting means, characterized by further comprising:

a PLL control circuit for rotating the driven side rotary shaft synchronously with the driving side rotary shaft under PLL control operation; and a gain-switching means for setting a high gain in the PLL control circuit when the driving side rotary shaft is accelerating or decelerating, and setting a low gain therein when the driving side rotary shaft is rotating in a steady state.

* * * * *